United States Patent [19]

Rumble

[11] Patent Number: 4,626,052

[45] Date of Patent: Dec. 2, 1986

[54] ELECTRICAL CONNECTORS

[76] Inventor: Clive S. Rumble, 51 Hays Mews, London, England, W1X 5DB

[21] Appl. No.: 698,882

[22] Filed: Feb. 6, 1985

[30] Foreign Application Priority Data

Feb. 8, 1984 [GB] United Kingdom ..... 8403294

[51] Int. Cl.[4] ..... H01R 29/00

[52] U.S. Cl. ..... 339/31 M; 339/31 R

[58] Field of Search ..... 339/31 R, 31 M, 32 R, 339/34, 154 A, 156 T

[56] References Cited

U.S. PATENT DOCUMENTS

| | | | |
|---|---|---|---|
| 2,163,201 | 6/1939 | Kalencik | 339/31 M |
| 3,025,486 | 3/1962 | Falconer | 339/31 R |
| 4,518,212 | 5/1985 | Rumble | 339/31 R |

FOREIGN PATENT DOCUMENTS

| | | |
|---|---|---|
| 0104279 | 4/1984 | European Pat. Off. . |
| 3109620 | 9/1982 | Fed. Rep. of Germany . |
| 2097202 | 10/1982 | United Kingdom . |

*Primary Examiner*—Gil Weidenfeld
*Assistant Examiner*—Paula A. Austin
*Attorney, Agent, or Firm*—Stevens, Davis, Miller & Mosher

[57] ABSTRACT

A multiplug adapter comprises a casing 1 containing a stack of sliding pin carriers 6. Each carrier 6 with a pin array can be advanced to an operative position by lugs L protruding from the side of the casing. Releasable detents associated with the lugs locate the sliding carriers in the forward and retracted conditions.

6 Claims, 17 Drawing Figures

ELECTRICAL CONNECTORS

DESCRIPTION

This invention relates to a plug-in electrical connecting device having a plurality of pin arrays, selectable to suit the appropriate mains power source to the locality of use. With the appropriate pin assembly selected and plugged in the device provides a power socket for an appliance with a plug which would not otherwise be usable. Such a multi-pin device will hereinafter be referred to as an "adaptor".

According to one aspect the present invention provides an adaptor comprising a casing, a plurality of sliding carriers each carrying an array of pins and slidable between a rear, pins-retracted position, and at least one forward, pins-protruding position, the carriers being disposed in stacked relationship and means for moving a selected one of the said carriers between the forward and rear positions.

More specifically and in accordance with another aspect of the present invention an adaptor comprises a casing, a plurality of sliding carriers in the casing each carrying an array of pins and slidable between a rear, pins-retracted, position and at least one front, pins-protruding, position, opposed guides in the casing wall engaged by complementary parts on the carrier and releasable detent means operable from outside the casing, the arrangement being that with a carrier moved at least to a front position and preferably also to the rear position the detent means operates securely to locate the carrier in that position until the detent is released.

Each sliding carrier will be conductively associated with appropriate means to connect the pin to the socket or other appliance connection at the rear of the adaptor.

Although other forms of carrier arrays can be envisaged with the releasable detent means the stacked is preferred. It is further preferred that operating lugs or other means for the carrier should also release and engage the detent means. These functions can however be separated.

In an embodiment the guides are slots extending along diametrically opposed positions in the walls of a tubular casing. A resiliently flexible limb extends from each side of a sliding carrier, each limb having an outwardly directed operating part to pass through the slot and being laterally inwardly movable against its resilience from outside the casing. The limb also has a projection to engage with corresponding notches on the casing thereby providing the detent. This arrangement can obviously be reversed with notches on the limb and projections on the casing. In use the operating parts can be used to move the sliding carrier and on arrival at an opposed pair of detents the limbs flex to lock the carrier. The sliding carrier can be disengaged from the detents by inward compression of the limbs against their inherent resilience.

A particular embodiment of the invention will now be described by way of example and with reference to the accompanying drawings wherein.

Figure 1:
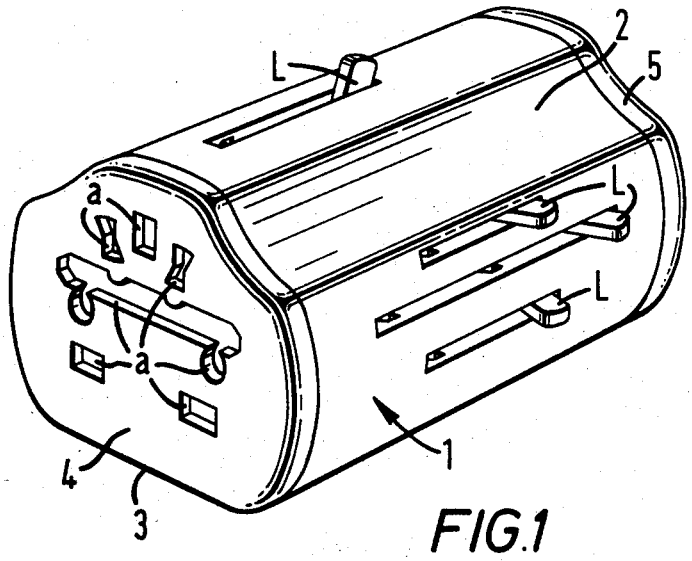
FIG. 1 is a perspective view of an adaptor in accordance with the invention with all the slides and pins retracted.
Figure 2:
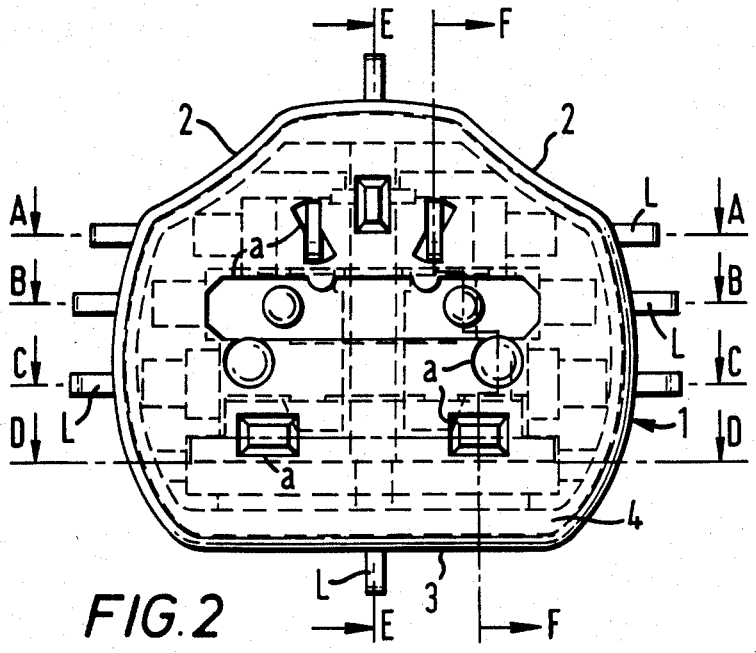
FIG. 2 is a front view of the adaptor with the interior components shown in dotted lines.
Figure 14:
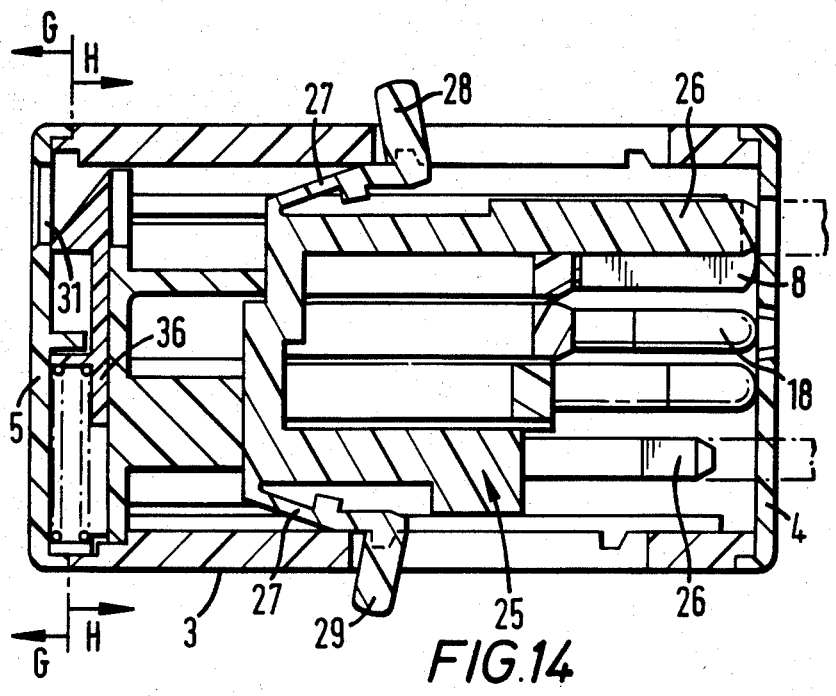
Figure 15:
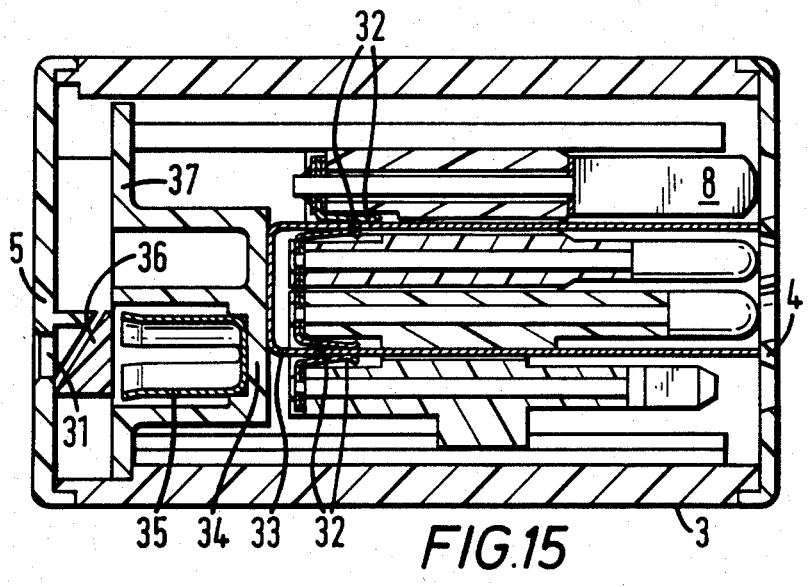
Figure 16:
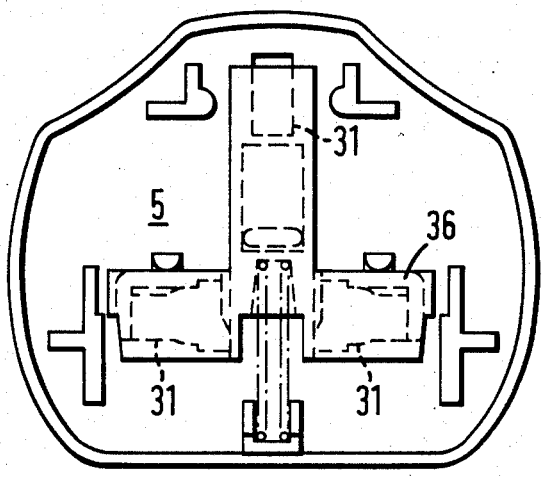
Figure 17:
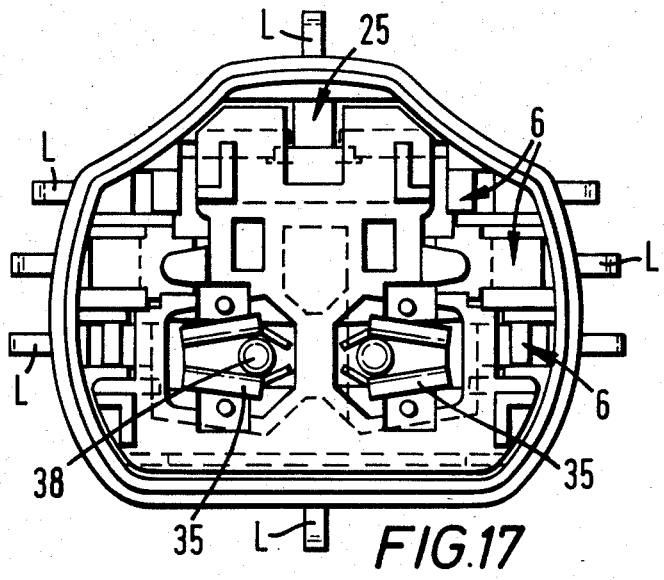

FIG. 15 is a section on the line F—F of FIG. 2 showing how the pins in the slides are electrically energised; and FIGS. 16 and 17 are sections on the line G—G and H—H of FIG. 14 illustrating the rear socket arrangement of the adaptor. Referring now to FIG. 1 of the drawings the adaptor illustrated comprises a tubular plastics casing 1 of rounded cross-section with chamfered top portions 2 to provide grip, and a flattened base 3. The casing has front and rear end covers 4 and 5. The front cover 4 has a plurality of apertures (a), to be described, to allow passage of pin arrays. Also well seen in FIG. 1 are operating lugs L to advance selectively the required pin arrays. These lugs will be systematically described hereinafter. At this stage it can be noted that there are an upper pair of lugs, an intermediate pair of lugs and a lower pair of lugs on opposed side walls and a pair of lugs on the upper and lower surfaces. Depending on the selective advance and retreat of a chosen lug pair a particular pin configuration is bought forward into an operating condition for engagement with a particular socket configuration. The appliance to be used can be plugged into socket apertures 31 at the rear of the casing. These apertures 31 can accept two and three pin configurations.

Figure 4:
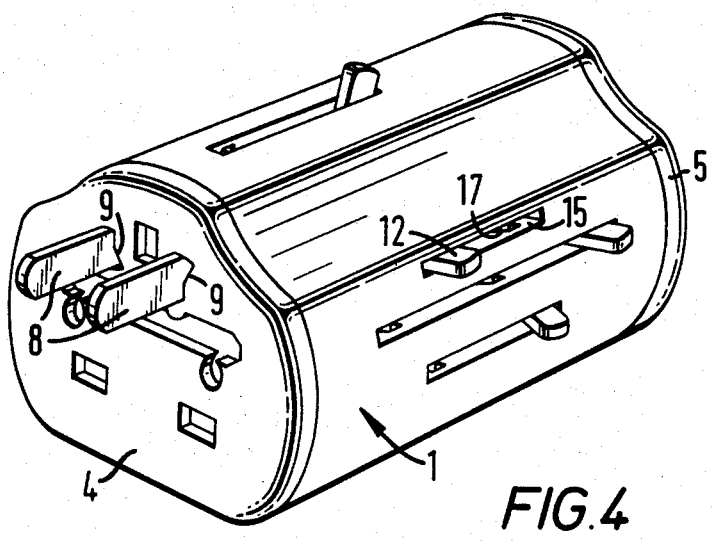
FIGS. 4 and 5 are perspective views of the adaptor with one of the slides advanced to the forward position with pins protruding, alternative angular orientation of the pins being shown.
Figure 5:
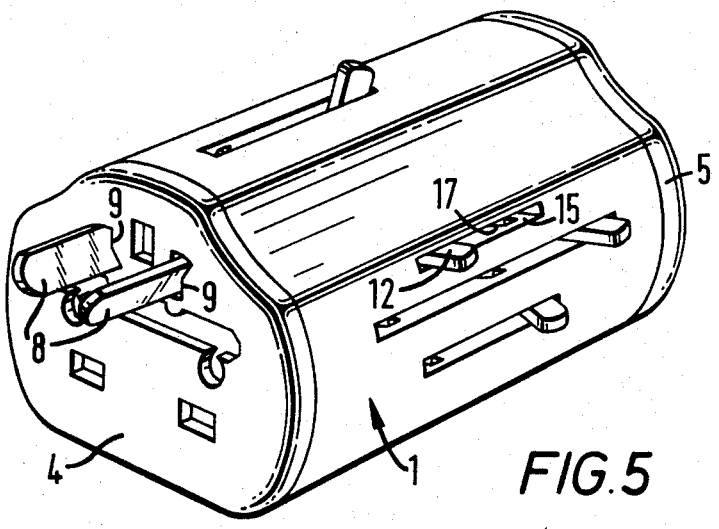
Figure 6:
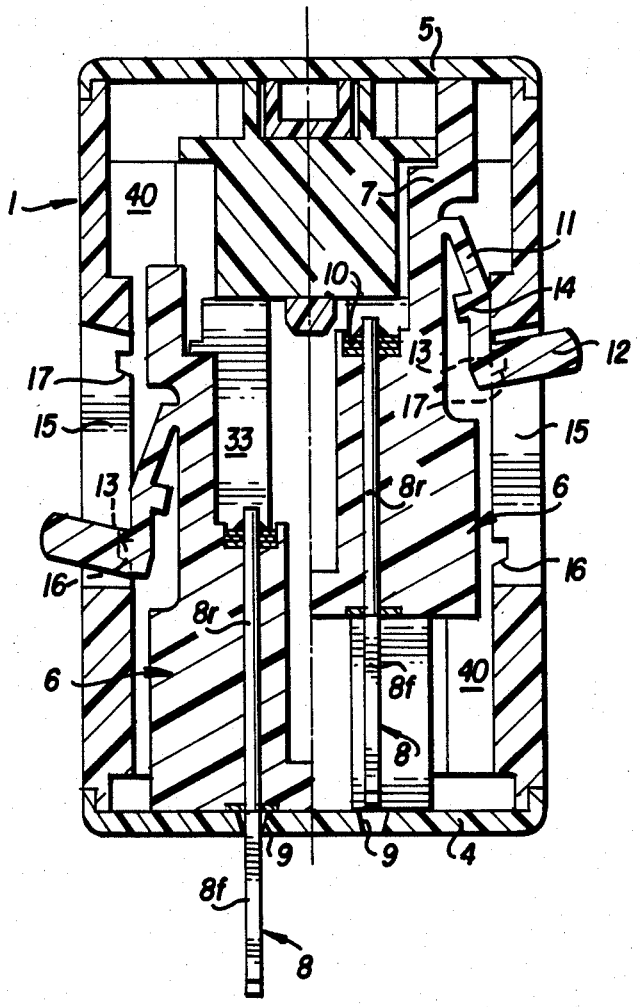
FIG. 6 is a section on the line A—A of FIG. 2 showing the advancing slide of FIGS. 4 and 5.

Returning to the detailed description reference will initially be made to FIGS. 4, 5 and 6. The upper slide 6 is formed in one-piece from hard plastics material and comprises a bifurcated body of generally rectangular form from which two legs 7 extend rearwardly. Opposed inwardly directed shelves 40 along each casing inner side wall provide guide structure in which the slide moves longitudinally in in the body. A pair of contact pins 8 extend forwardly from the slide through slots 9 in the body front cover 4. The pins are of two-part construction with a flat front part **8*f* and a rear part 8*r*. Part 8*f* is in the form of a strip and part 8*r* in the form of a cylinder mounted for limited rotation about its axis. The forward position of the slide offers two pin configurations, with the pins straight for the USA in FIG. 4 and in FIG. 5 the pins rotated about the long axes to an inclined position for Australian and New Zealand sockets. An integrally formed resiliently flexible limb 11 extends forwardly and outwardly from each leg 7 to a laterally outwardly extending operating part or lug 12. Under the lug 12 is provided a detent projection 13. An inwardly extending stop 14 is provided to limit inward flexing of limb 11. The casing 1 has, at each side, an elongate rectangular slot 15 within which the lug 12 can be moved between front and rear positions to advance the pins 8. On the lower wall of each slot are provided front and rear detent recesses 16 and 17**.

The section A—A shown in FIG. 6 and the corresponding later section show the slide in divided form, one half, the right half, showing the retracted slide with the projection 13 engaging the slot 17 whilst on the left hand side the pin is shown advanced with the projection 13 engaging the recess 16. In both front and rear position the slide is securely locked until the lug is depressed to free the projection 13 from the respective detent. Excessive inward movement of the lug is limited by abutment of the stop 14 on the main body of the slide. The limbs 11 are deeper than the slots 15 so that in the forward position the limbs close the slot and act as a safety shroud.

Figure 7:
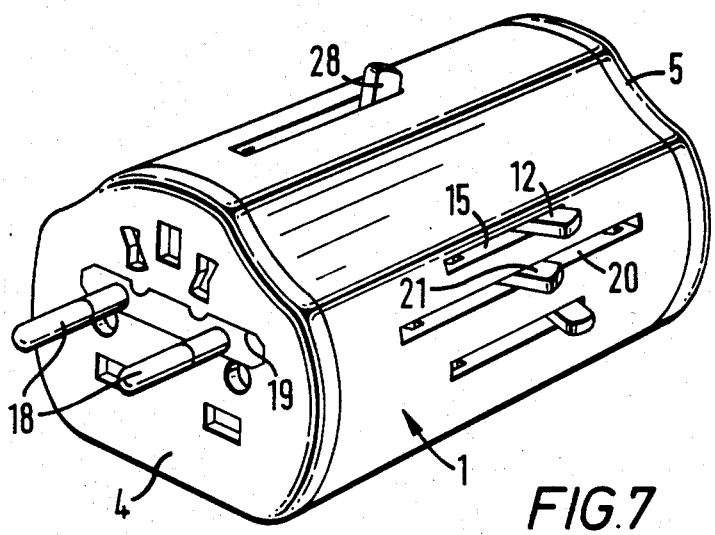
FIG. 7 is a perspective view showing the adaptor with another slide advanced to a first position.
Figure 8:
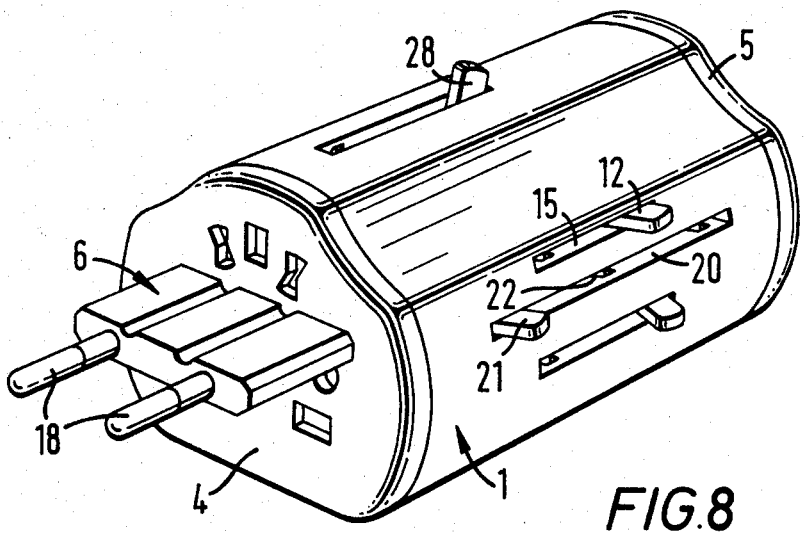
FIG. 8 is a similar view indicating the slide shown in FIG. 7 advanced further to a second position.
Figure 9:
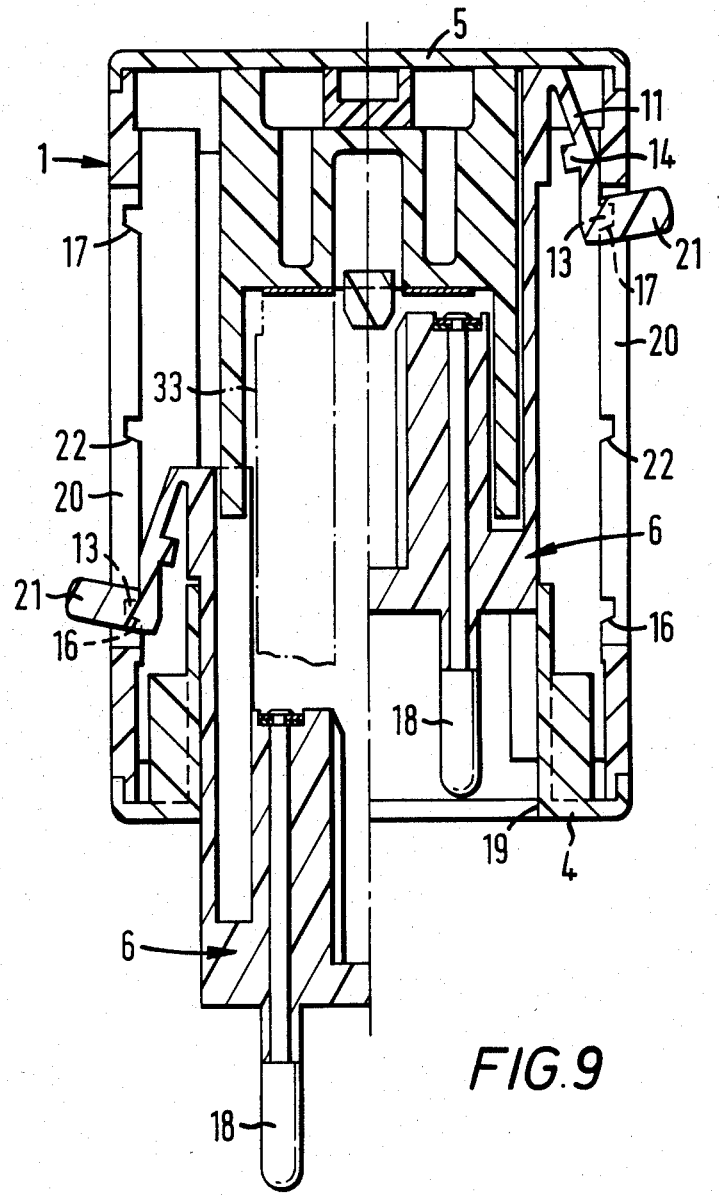
FIG. 9 is a section on the line B—B of FIG. 2 showing the advancing slide FIGS. 7 and 8.

FIGS. 7, 8 and 9 illustrate the intermediate pair of lugs selectively advancing round profile pins 18 through a wide slot 19 in front cover 4. In this slide and indeed in the slides described hereinafter the pins are effectively an electrically conductive tip and core in an electrically insulating body. The slide is constructed as before, and like parts are identified by like reference numerals. It should be noted however, that the slot 20 in which operating lug 21 moves is substantially greater length than the slot 15 and has not only front and rear detents but an intermediate detent 22 shown engaged in FIG. 7. The section on FIG. 9 corresponds to FIG. 8 and shows the slide 6 advanced to the front position with a part to mate with the German "Shuko" type recessed socket. In the intermediate position with the detent projection 13 engaging the intermediate detent recess 22 the front of the slide 6 is flush with the front of the case and that is the configuration shown in FIG. 7. This is the configuration for other countries on the continent of Europe such as Spain. Differences in the guide structure in the casing for the slide should also be noted. Elongate guide posts 24 engage mating sockets 25 in the rear of the slide.

Figure 10:
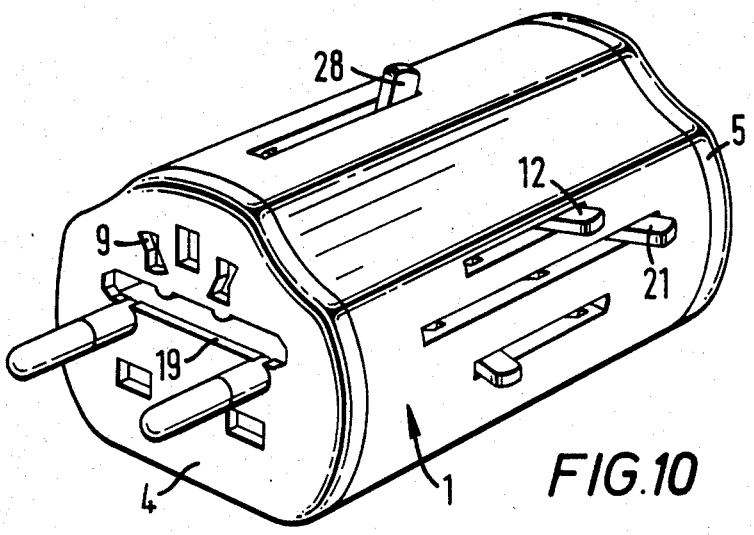
FIG. 10 is a perspective view of the adaptor with another slide advanced.
Figure 11:
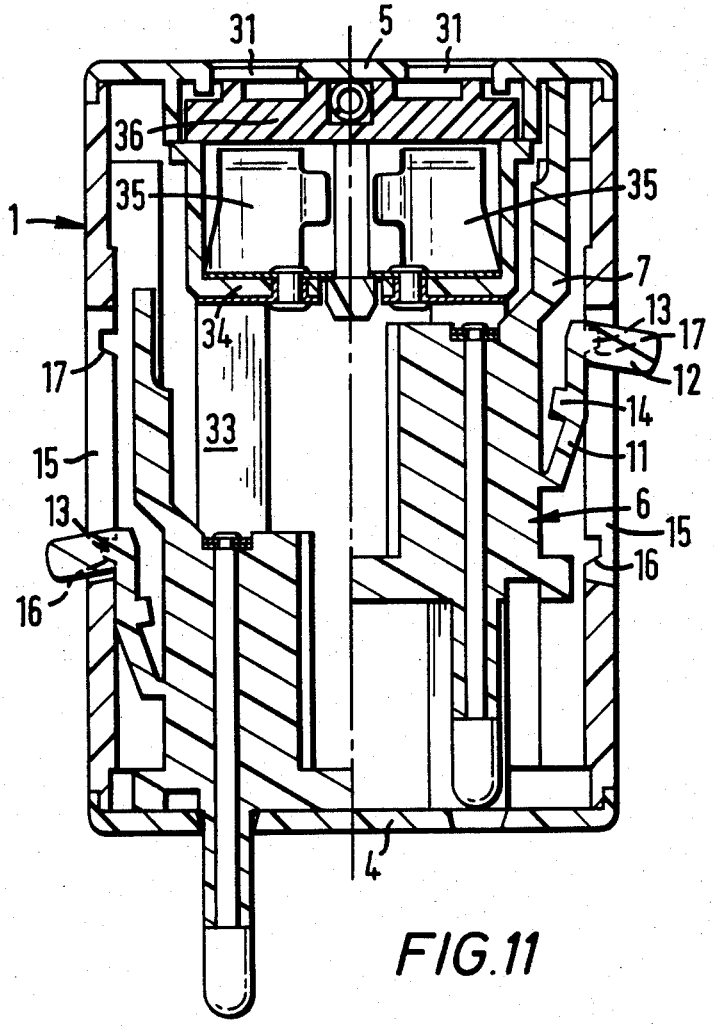
FIG. 11 is a section on the line C—C of FIG. 9 showing the advancing slide of FIG. 10.

The configuration shown in FIGS. 10 and 11 requires little comment though again the rear of the slide has a slightly different configuration. Again like reference numerals identify like parts. In principle however, the arrangement is similar to that described with reference to FIGS. 4 to 6. The pins are for Italian sockets.

Figure 12:
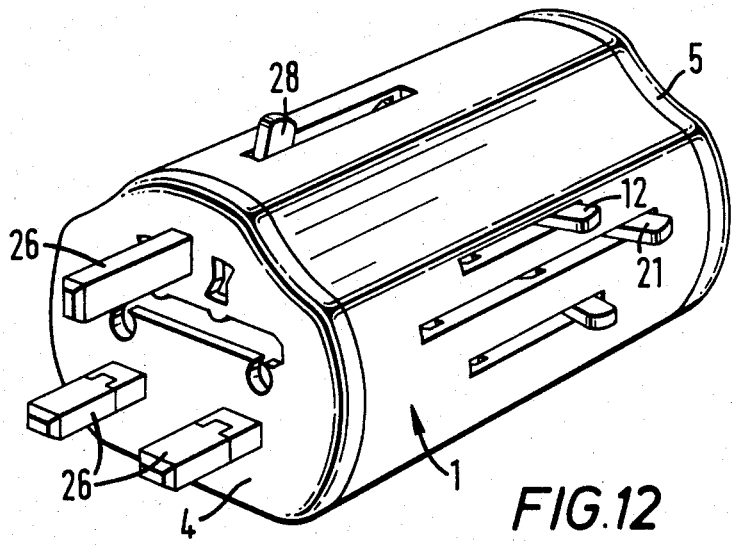
FIG. 12 is a perspective view showing another slide advanced, that carrying three pins.
Figure 13:
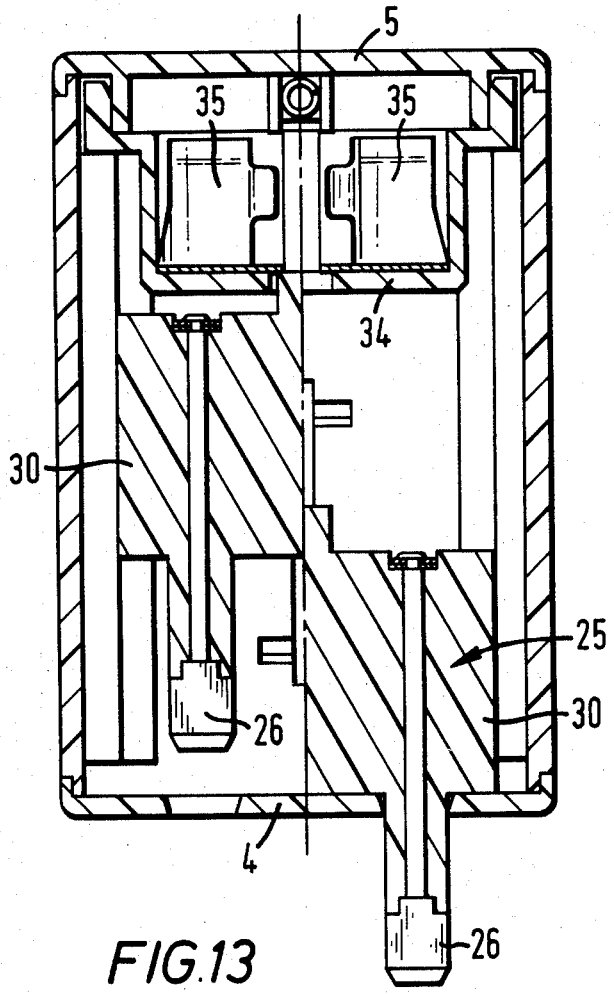
FIGS. 13 and 14 are sections on the line D—D and E—E of FIG. 2 showing the advancing slide of FIG. 12.

FIG. 12 and the corresponding sections in FIGS. 13 and 14 represent a three-pin array for U.K sockets however require more detailed description.

The slide 25 carrying the three conductive-tipped pins 26 comprises a vertically disposed generally C-shaped member with limbs 27 corresponding to the limbs 11 of FIG. 6 with the operating lugs 28, 29 on the upper and lower walls of case 1 and similar detent and stop arrangements. There is also provided as can best be seen from FIG. 13 a basal cross-member 30 serving as the carrier for the lower round pins, the operating limb 27 with the lug 29 protruding from the underside of this member 30. As before the operation comprises resilient depression of the limbs and sliding engagement of the studs with the detents.

Figure 3:
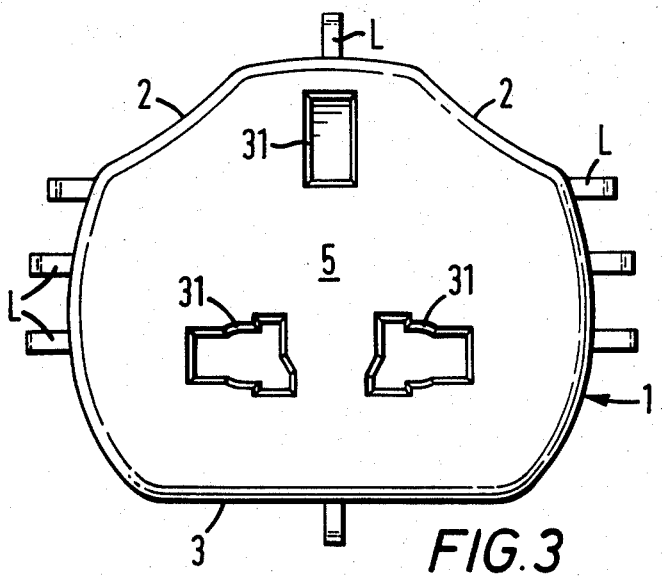
FIG. 3 is a rear view of the adaptor.

The electrical connection arrangement to the rear socket entrances 31 (see FIG. 3) can be appreciated from FIGS. 15 to 17. Each conductive pin has a rear conductive fixing to a conductive shoe 32. On each side of the casing is disposed a U-shaped conductor 33, live or neutral according to the casing side. The shoes 32 of the upper pins engage the upper surface of the upper limb of conductor 33 and the bottom pair of pins the undersurface. Each U-shaped conductor is fastened to a bulkhead 34 by a conductive pin 38 (FIG. 17) passing through the bulkhead to a resiliently flexible conductive channel 35 constituting a socket member. As can best be seen from FIGS. 17 and 15 bulkhead 34 forms part of transversely extending wall structure 37 extending across the rear of the interior of casing 1. This structure not only houses socket channels 35 but also provides a guide and back stop for the rear of the slides.

Means can be provided for connecting the upper flat pin of the British type arrangement to the rear earth socket. In the absence of such connection the pin 26 will be made of insulating plastic. A movable safety shutter 36 (see FIG. 16) is provided inside rear cover 5. This shutter, under spring bias covers entrances 31 until pushed aside by an entering plug.

In an alternative construction the slides 5, 7, 8 and 10 are formed for sliding interengagement with one another. As a further modification the rear of the casing may include a voltage converter/transformer with control means on the casing exterior. The adapter can thus deal with different voltage values in a power supply.

In the device, as described above, the possibility exists for two or more slides to be advanced together. This is undesirable from the standpoint of safety and it is proposed to incorporate some means such as a rotatable shutter which obstructs the forward sliding of all but a selected slide. As an alternative the terminal tips may be of electrically insulating material.

I claim:

1. An adaptor comprising a casing, a plurality of sliding carriers each carrying an array of pins and slidable between a rear pins-retracted position and at least one forward pins-protruding position, the carriers being disposed in stacked relationship and means for moving a selected one of the said carriers between the forward and rear positions.

2. An adapter comprising a casing, a plurality of sliding carriers in the casing each carrying an array of pins and slidable between a rear pins-retracted position and at least one front pins-protruding position, opposed guides in the casing wall engaged by complementary parts on the carrier and releasable detent means operable from outside the casing, the arrangement being that with a carrier moved at least to a front position and preferably also to the rear position the detent means operates securely to locate the carrier in that position until the detent is released.

3. An adapter according to claim 2 wherein means for moving the sliding carrier also control the detent means.

4. An adapter according to claim 2 wherein the sliding carriers are positioned in stacked relationship one above the other in the casing.

5. An adapter according to claim 4 wherein the guides are slots extending along diametrically opposed positions in the walls of a tubular casing and operating lugs for the detent means protrude from the said slots.

6. An adapter according to claim 5 wherein each lug is carried on a resiliently flexible limb extending from one side of a sliding carrier, the limb and the casing being formed for notched and projection inter-engagement to provide the detent, the detent being released by laterally inward movement of the limb.

* * * * *